United States Patent [19]

Whitford

[11] 4,227,325

[45] Oct. 14, 1980

[54] GRAVE MARKER

[76] Inventor: Leon Whitford, 1015 S. 5th St., Greenville, Ill. 62246

[21] Appl. No.: 957,524

[22] Filed: Nov. 3, 1978

[51] Int. Cl.[3] ..... G09F 19/00

[52] U.S. Cl. ..... 40/124.5; 40/19; 40/361

[58] Field of Search ..... 40/124.5, 152, 361, 40/363, 364, 10 D, 19, 362; 52/103, 104

[56] References Cited

U.S. PATENT DOCUMENTS

| | | | |
|---|---|---|---|
| 291,106 | 1/1884 | Strong | 40/124.5 |
| 507,529 | 10/1893 | Doe | 40/364 X |
| 528,631 | 11/1894 | Green | 40/124.5 |
| 631,890 | 8/1899 | Hawthorne | 40/124.5 |
| 669,412 | 3/1901 | Harriman | 40/152 |
| 955,720 | 4/1910 | Thomas | 40/124.5 |
| 3,438,159 | 4/1969 | Bergener | 40/124.5 X |

*Primary Examiner*—Gene Mancene
*Assistant Examiner*—Wenceslao J. Contreras
*Attorney, Agent, or Firm*—Gravely, Lieder & Woodruff

[57] ABSTRACT

A grave marker having a base, a marker, and a chamber for displaying pictures, photographs, or the like. The chamber is a hollow tube, preferably cylindrical in shape. Within the chamber is mounted the picture. The picture can be viewed by an observer through an eyepiece set into the wall of the chamber. Ilumination is provided through the ends of the tubular chamber. Since sunlight does not directly strike the picture, deterioration of the picture is minimized.

5 Claims, 2 Drawing Figures

GRAVE MARKER

BACKGROUND OF THE INVENTION

The present invention relates to the area of grave markers, and, in particular, grave markers in which pictures, photographs, etc. can be displayed.

Although cemetery markers generally display the name and vital statistics of the individual involved, it is often desired that the deceased's photograph or other pictorial representation be included on the grave marker. A problem with pictorial representations is that they are subject to deterioration from ultraviolet radiation emanating from the sun's rays.

Zentmeyer U.S. Pat. No. 2,312,859 discloses a grave marker having provision for a photograph to be mounted in a recessed frame in the face of the marker.

Warembourg U.S. Pat. No. 2,068,830 shows a memorial placque for attachment to a gravestone which placque has a place for a picture to be positioned behind a convex glass cover.

Bergener U.S. Pat. No. 3,438,159 shows a cemetery marker with a recess to hold a picture which has been cast in layers of plaster with the inner layers colored to form a background for the picture and the outer layer clear to allow the picture to be seen.

Burgener U.S. Pat. No. 3,570,159 shows a similar construction with a clear ultra violet filter face to prevent deterioration of the photograph from blue-violet radiation. Thus Burgener U.S. Pat. No. 3,570,159 shows an appreciation of the problem which the present invention solves in a unique fashion.

A primary object of this invention is to provide new and useful cemetery marker wherein the marker is capable of exhibiting pictures, photographs, and the like to observers.

A further object is to provide in cemetery markers a means for displaying photographs, etc. without exposing the photographs to excessive amounts of ultraviolet light.

These and other objects and advantages will become apparent hereinafter.

BRIEF DESCRIPTION OF DRAWINGS

In the drawings, where like numbers refer to like parts whenever they occur.

SUMMARY OF THE INVENTION

This invention involves a grave marker having a base, a marker, and a hollow tubular chamber in which pictures, photographs, etc. can be displayed. The picture is mounted in glass and placed within the chamber in such a position that it can be viewed through an eyepiece set into the wall of the chamber. Illumination is provided through the ends of the tubular chamber. Consequently, ultraviolet rays from the sun do not directly impinge upon the picture.

DETAILED DESCRIPTION

Figure 1:
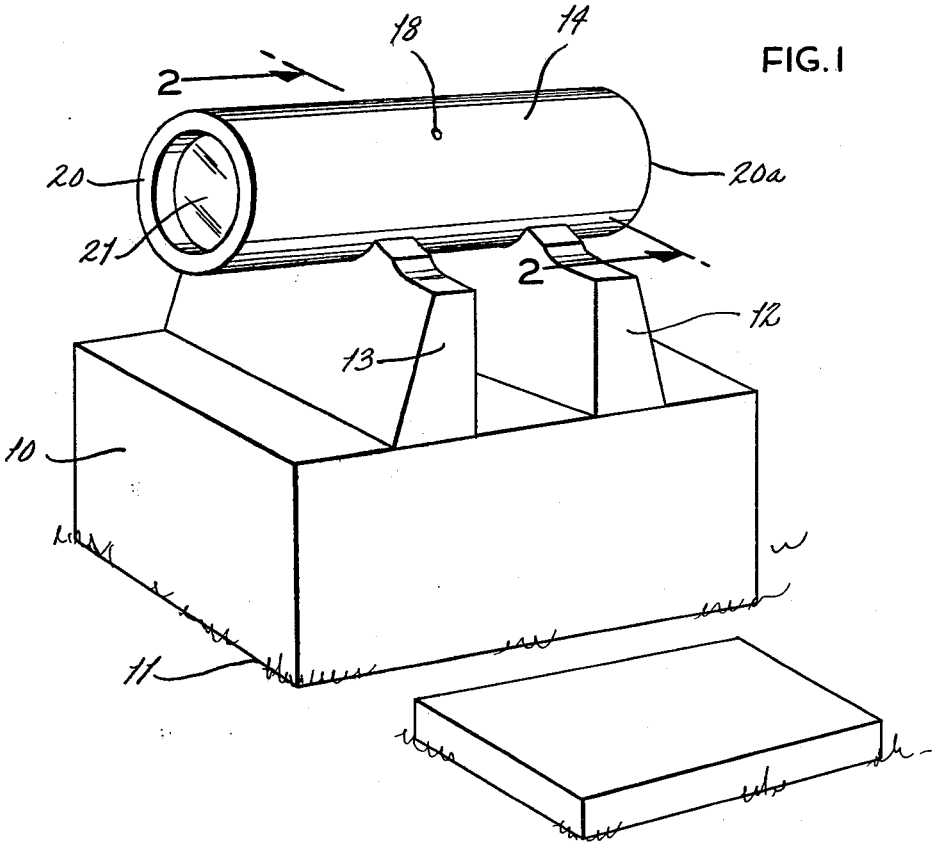
FIG. 1 is a perspective view of a cemetery marker incorporating the device of the present invention.

FIG. 1 shows a grave marker 10 mounted on a base 11 which is embedded in the ground.

The marker 10 itself may be made of a number of materials ranging from wood to marble, stone, and metal.

The base 11 may be made of a number of materials. The preferred material is concrete, but stone or metal is also suitable.

Figure 2:
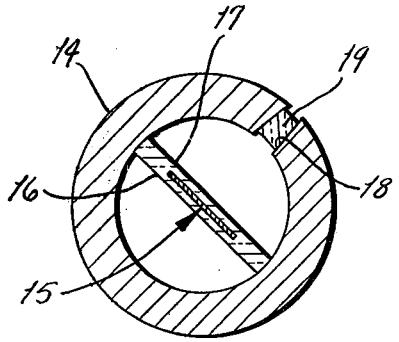
FIG. 2 is a cross-sectional view along lines 2—2 showing the means for mounting and viewing the picture.

Located upon the marker 10 are supports 12, 13 for a tubular chamber 14, which serves as the housing for a picture 15 (FIG. 2) to be preserved. The supports 12, 13 preferably are made of the same material as the marker itself, i.e., if the marker 10 is made of granite, the supports 12, 13 should be made of granite. A single support can be used, if desired.

The tubular chamber 14 may have any of a number of configurations. In the embodiment shown, the tubular chamber 14 is in the shape of a cylinder. The cylinder has a hollow core. The wall thickness is about 3 times the diameter of the core. The tubular chamber 14 is attached to supports 12, 13 by means of steel anchor pins (not shown) to provide security and stability for the chamber 14.

The tubular chamber 14 is open at both ends **20, 20*a* of the chamber. Transparent seals 21 are inserted into each end 20, 20*a* of the chamber 14. The seals 21 are made of a material pervious to light, e.g. glass, Plexiglass, etc. In the preferred embodiment, the seals 21 are recessed from the ends 20, 20*a* of the chamber 14 to minimize the possibility of breakage or accidental removal. The purpose of the seals 21 is to prevent moisture, dust, and other foreign objects from entering the tubular chamber 14. The seals 21 may be of any thickness. The only requirements are that they do not screen out so much light that the picture 15 is rendered unviewable in normally bright daylight. The linear dimensions of the seals 21 should be such that they fit tightly against the inner walls of the tubular chamber 14. Also the length of the chamber 14 in relation to the diameter of the core should be such that light will enter the ends 20, 20*a* and be transmitted to a point half way distant between the ends 20, 20*a***.

The picture 15 preferably is mounted between two transparent plates 16, 17. The plates 16, 17 may be made of such material as glass, Plexiglass, etc. The essential requirement is that the plate material be resistant to deterioration by heat, moisture, etc.

The plates 16, 17 are mounted on the inside of the chamber 14 by any suitable means, such as glue, etc., at a point midway between the ends **20, 20*a* so that the picture 15 is illuminated by light entering the chamber from either end 20, 20*a* of the chamber 14**.

An opening 18 is located in the wall of the chamber 14 in juxtaposition to the picture 15 to permit an observer to view the mounted picture 15.

By looking through the eyepiece 19 an observer may view the picture 15 mounted in the tubular chamber 14.

On a day with normal sunlight, sufficient light should enter the ends **20, 20*a* of the tubular chamber 14 to provide indirect illumination for viewing the picture 15. When light enters through the chamber ends 20, 20*a*, exposure of the picture 15 to ultraviolet light is reduced substantially relative to what the exposure would have been if sunlight shined directly upon the picture 15. This prevents deterioration and decay of the picture 15**.

On overcast days or at night, the observer may direct an artificial source of light, e.g., a flashlight, through the eyehole 18 in order to provide the illumination for viewing the pictorial representation 15 in the tubular chamber 14.

What is claimed is:

1. A grave marker comprising a base and a horizontally extending, elongate chamber mounted on said base, retaining means spaced from the ends of said chamber for holding a picture or the like in a position disposed within a plane extending longitudinally within the chamber and spaced from the ends of the chamber in facing relation to a side wall of the chamber, said chamber having through said side wall a view port aligned with the picture or the like and there being lens means sealing said view port for viewing said picture or the like, and indirect light transmitting means closing at least one end of said chamber for passing sunlight into said chamber without direct impingement upon said picture or the like.

2. The marker of claim 1 wherein the chamber is in the shape of a cylinder.

3. The marker of claim 1 wherein the retaining means for holding the picture or the like, is a sandwich-type enclosure made of transparent material which is pervious to light.

4. The marker of claim 2 wherein the means for allowing light to illuminate said picture are transparent seals positioned adjacent to the ends of said cylindrical chamber to seal the ends so that foreign objects cannot enter said chamber.

5. The marker of claim 2 wherein the lens means for viewing said picture is a magnifying eyepiece.

* * * * *